US005532548A

United States Patent [19]

Spindt et al.

[11] Patent Number: 5,532,548

[45] Date of Patent: Jul. 2, 1996

[54] FIELD FORMING ELECTRODES ON HIGH VOLTAGE SPACERS

[75] Inventors: Christopher J. Spindt, Menlo Park; John E. Field, Redwood City; David L. Morris, San Jose; Christopher J. Curtin, Los Altos Hills, all of Calif.

[73] Assignee: Silicon Video Corporation, Campbell, Calif.

[21] Appl. No.: 317,205

[22] Filed: Oct. 3, 1994

Related U.S. Application Data

[63] Continuation-in-part of Ser. No. 188,857, Jan. 29, 1994, which is a continuation-in-part of Ser. No. 12,542, Feb. 1, 1993, which is a continuation-in-part of Ser. No. 867,044, Apr. 10, 1992, Pat. No. 5,424,605.

[51] Int. Cl.[6] ..... H01J 19/42

[52] U.S. Cl. ..... 313/422; 313/495; 313/258; 313/292

[58] Field of Search ..... 313/422, 495, 313/482, 258, 292, 306, 311

[56] References Cited

U.S. PATENT DOCUMENTS

| | | | |
|---|---|---|---|
| 4,020,381 | 4/1977 | Oess et al. | 313/351 X |
| 4,163,949 | 8/1979 | Shelton | 313/309 X |
| 4,174,523 | 11/1979 | Marlowe et al. | 313/422 X |
| 4,622,492 | 11/1986 | Barten | 313/422 |
| 4,900,981 | 2/1990 | Yamazaki et al. | 313/422 |
| 5,003,219 | 4/1991 | Muragishi et al. | 313/422 X |
| 5,063,327 | 11/1991 | Brodie et al. | 313/495 X |
| 5,083,058 | 1/1992 | Nonomura et al. | 313/422 X |
| 5,116,704 | 5/1992 | Kwon | 313/495 X |
| 5,160,871 | 11/1992 | Tomii et al. | 313/422 X |
| 5,170,100 | 12/1992 | Shichao et al. | 313/422 X |
| 5,227,691 | 7/1993 | Murai et al. | 313/422 |
| 5,229,691 | 7/1993 | Shichao et al. | 313/422 X |
| 5,386,175 | 1/1995 | Von Gorkom et al. | 313/422 |

FOREIGN PATENT DOCUMENTS

| | | |
|---|---|---|
| 0436997A1 | 7/1991 | European Pat. Off. . |
| 0464938A1 | 1/1992 | European Pat. Off. . |
| 0496450A1 | 7/1992 | European Pat. Off. . |
| 0580244A1 | 1/1994 | European Pat. Off. . |
| 93/18536 | 9/1993 | WIPO . |

OTHER PUBLICATIONS

Andreadakis et al., "Influence of Barrier Ribs on the Memory Margin of ac Plasma Display Panels", *Proceedings of the SID*, vol. 31, No. 4, pp. 355–360, (1990).

Fujii et al., "A Sandblasting Process for Fabrication of Color PDP Phosphor Screens", *SID 92 Digest*, pp. 728–731, (1992).

Terao et al., "Fabrication of Fine Barrier Ribs for Color Plasma Display Panels by Sandblasting", *SID 92 Digest*, pp. 724–727, (1992).

*Primary Examiner*—Sandra L. O'Shea
*Assistant Examiner*—Ashok Patel
*Attorney, Agent, or Firm*—Haynes & Davis

[57] ABSTRACT

A flat panel display includes a faceplate and an opposing backplate. The two are sealed together and a sealed envelope is created that includes an active area of length $L_1$. The active layer includes addressable pixels on the faceplate. Spacers are perpendicular to the faceplate and backplate. The length of a spacer is in a direction parallel to the plane of the faceplate. At least one spacer is positioned in the envelope and provides rigidity to the display. This is required because of the high vacuum which is maintained within the envelope. One or more electrodes are formed on an exterior surface of the spacer. The electrodes extend a length of $L_2$ along a side of the spacer that is at least equal to $L_1$. Voltages applied to the electrodes are controlled to achieve a desired voltage distribution between the backplate and the faceplate. The electrode is made of a material with a sheet resistance of less than about $10^5$ to $10^7$ Ω/□. The potential drop across the spacer between the faceplate and the backplate can be tailored by the selection of the position of the electrodes on the spacers, as well as the potentials applied to the electrodes. An additional way of tailoring the potential drop is selecting a desired thickness or conductivity of the spacer from top to bottom.

30 Claims, 5 Drawing Sheets

FIELD FORMING ELECTRODES ON HIGH VOLTAGE SPACERS

CROSS-REFERENCE TO RELATED APPLICATIONS

This application is a continuation-in-part of U.S. patent application Ser. No. 08/188,857 entitled "Structure and Operation of High Voltage Supports: by Spindt et al., filed Jan. 29, 1994, which is a continuation-in-part of U.S. patent application Ser. No. 08/012,542, entitled "Internal Support Structure For Flat Panel Device," by Fahlen et al., filed Feb. 1, 1993, which is, in turn, a continuation-in-part of U.S. patent application Ser. No. 07/867,044, entitled "Self Supporting Flat Video Display," by Lovoi, filed Apr. 10, 1992, now U.S. Pat. No. 5,424,605. This application is related to U.S. patent application entitled "Metallized High Voltage Spacers", filed by Chris Spindt et al, Ser. No. 08/317,299, filed Oct. 3, 1994.

BACKGROUND OF THE INVENTION

1. Field of the Invention

This invention relates generally to flat panel display devices, and more particularly, to large flat panel display devices that use one or more support structures for internally spacing the faceplate and the backplate, with the support structures providing for charge bleed off.

2. Description of the Related Art

In recent years there have been numerous activities relating to the construction of flat panel displays to replace conventional deflected-beam CRT displays. Flat panel displays are lighter and less bulky. In addition to flat CRT displays, other flat panel displays, such as plasma displays, have also been developed.

Flat panel displays include a faceplate, a backplate and connecting walls around the periphery of the faceplate and backplate, forming a vacuum envelope. In some flat panel displays, the envelope is held at vacuum pressure which in the case of CRT displays the vacuum held is about $1\times10^{-7}$ torr or less. The interior surface of the faceplate is coated with light emissive elements, such as phosphor or phosphor patterns, which define the active region of the display. Cathodes located adjacent to the backplate are excited to release electrons which are accelerated toward the phosphor on the faceplate. The electrons impact the phosphors, and the phosphors emit light seen by the viewer at the exterior of the faceplate.

The vacuum environment produces a force which is exerted on the walls on the flat panel display. If left unopposed, the flat panel display can collapse. In rectangular displays having greater than approximately a 1 inch diagonal, the faceplate and backplate are particularly susceptible to this type of mechanical failure due to their high aspect ratio. The aspect ratio is the distance between support structure in the display divided by the thickness of the faceplate or backplate. The faceplate or backplate of a flat panel display may also fail due to external forces resulting from impacts sustained by the flat panel display.

Spacers have been used to internally support the faceplate and/or the backplate. Previous spacers have been walls or posts located between pixels (phosphor regions that define the smallest individual picture element of the display) in the active region of the display.

Spacers can adversely affect the flow of electrons toward the faceplate in the vicinity of the spacer. Stray electrons may electrostatically charge the surface of the spacer, changing the voltage distribution near the spacer from the desired distribution and resulting in distortion of the electron flow. This results in distortions in the image produced by the display.

The use of spacer walls has been reported in U.S. Pat. No. 4,900,981; U.S. Pat. No. 5,170,100; EPO 464 938 A1; EPO 436 997A1 where horizontal walls in the display are used to localize electron beam withdrawals through apertures; EPO 580 244A1 where the wall structures have a very high ohmic layer on only the fine selection side of the walls; and EPO 496 450 A1 which discloses wall structures made of a variety of materials.

It would be desirable to provide a flat panel display device with spacers that have a low enough sheet resistance to bleed charge. There is a need to bleed charge away from the spacer, e.g., stray electrons from the electron source striking spacers, and yet maintain the high potential difference across the spacer without running a high current through it, and also permit the tailoring of potential distribution.

SUMMARY

It is an object of the invention to provide a flat panel display device with spacers that are segmented by one or more conductors.

Yet another object of the invention is to provide a flat panel display device with spacers that include one or more conductors which extend along a length that is at least equal to a length of an active area of the display.

A further object of the invention is to provide a flat panel display device with spacers that include more than one conductor on a spacer, with the conductors being substantially parallel.

Still another object of the invention is to provide a flat panel display device with conductors on spacers, with the first conductor having a synchronized voltage applied to it in order to correct for pixel deflections.

An object of the invention is to provide a large display, such as ten inches in the diagonal, with less then 1 W of dissipated power.

Another object of the invention is to provide a flat panel display device with conductors on spacers having a sheet resistance of $10^5$ to $10^7$ Ω/□ or less.

Still a further object of the invention is to provide spacers for a flat panel display device with tailored potential drops.

Yet another object of the invention is to provide spacers for flat panel displays that include one or more conductors that provide for correction of distortions resulting from imperfections in the spacers, or from their misalignment.

The flat panel apparatus of the invention includes a faceplate and a backplate. Both are joined together, and a sealed envelope is created between them. Because of the vacuum condition maintained in the envelope, one or more spacers are positioned in the envelope to provide support. Spacers are perpendicular to the faceplate and backplate. The length of the spacer is in a direction parallel to the plane of the faceplate. At least one electrode is included on a spacer surface that is perpendicular to the faceplate. The electrode extends along the length of the spacer that is at least equal to the length of an active area of the display. The active area includes the addressable pixels on the faceplate. Voltages applied to electrodes on the spacers are controlled in order to achieve a desired voltage distribution between the backplate and the faceplate. Each electrode is made of a material that has a sheet resistance less than about $10^5$ to $10^7$ Ω/□.

A power supply establishes the voltage of each electrode. Spacers can be coated with a material that has a secondary emission ratio less than 4, and a sheet resistance between $10^9$ and $10^{14}$ Ω/□.

The flat panel apparatus of the invention has one or more spacers which have selectable, tailored, potential drops. This is achieved by the selection of the position of the electrodes on the spacers, the potential applied to the electrodes and the thickness or conductivity of the spacer from its top to its bottom.

DESCRIPTION OF THE DRAWINGS

FIG. 1(*b*) is a perspective view of the active region, an electrode on a spacer, and their respective sizes.

DETAILED DESCRIPTION OF THE PREFERRED EMBODIMENTS

In the following description, embodiments of the invention are described with respect to a flat cathode ray tube (CRT) display. It will be appreciated that the invention is applicable to other flat panel displays, including but not limited to plasma displays, vacuum fluorescent displays, and the like.

Herein, a flat panel display is a display in which a faceplate and backplate are substantially parallel, and the thickness of the display is small compared to the thickness of a conventional deflected-beam CRT display, the thickness of the display being measured in a direction substantially perpendicular to the faceplate and backplate. Often the thickness of a flat panel display is substantially less than about 2.0 inches, and in one embodiment it is about 0.15 inches.

Figure 1A:
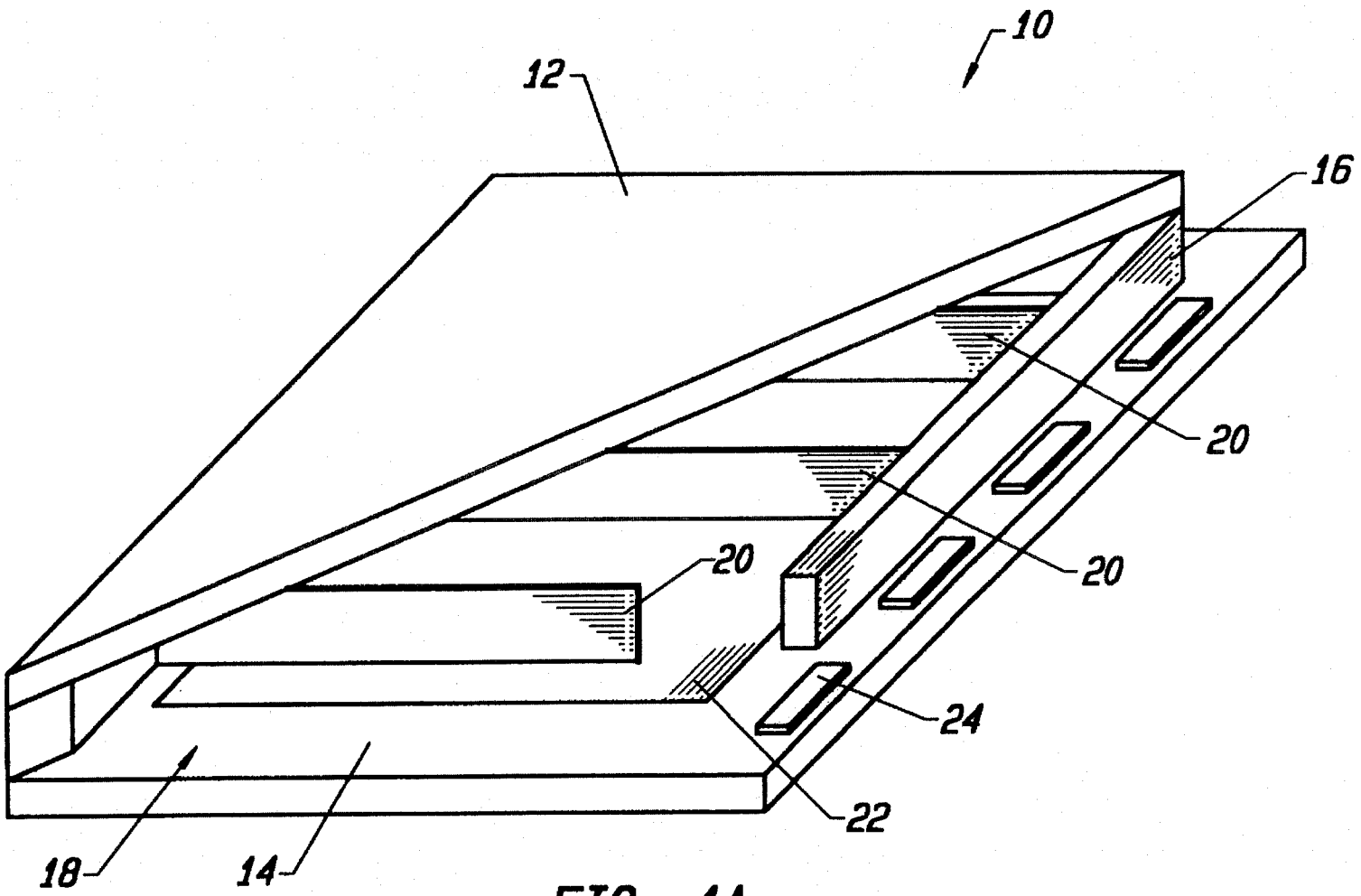
FIG. 1 (*a*) is a perspective cutaway view of a flat panel display including a field emission cathode according to one embodiment of the invention.
Figure 1B:
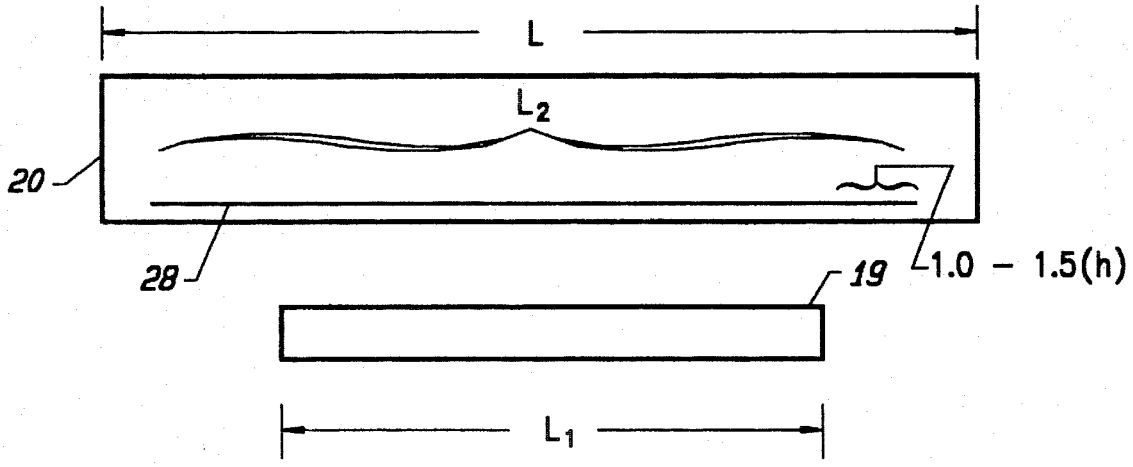

Referring now to FIGS. 1(*a*) and 1(*b*), a flat panel display 10 includes a faceplate 12, backplate 14 and side walls 16, which together form a sealed envelope 18 that is held at vacuum pressure, e.g., approximately $1\times10^{-7}$ torr or less. Within envelope 18, at an interior side of faceplate 12, is a phosphor coated emissive active area 19 of length "$L_1$". One or more spacers 20 support faceplate 12 against backplate 14. Spacer 20 has a longitudinal length of "L". An electrode 28 formed on spacer 20 has a length of "$L_2$". Spacers can include walls, posts, wall segments and focus structures.

In one embodiment, spacers 20 are walls that extend generally from one side to the other of sealed envelope 18. Spacers 20 are formed to provide support and do not adversely affect electron flow to faceplate 12.

Spacers 20 must have a sufficiently small thickness so that they provide minimal interference with the operation of cathode structures or phosphors. Spacers 20 are preferably made of a thin material that is compatible with use in a vacuum environment. Spacers 20 are made of a material with a coefficient of thermal expansion that closely matches the coefficients of thermal expansion of faceplate 12 and backplate 14.

In one embodiment of the invention, spacers 20 are made of a ceramic or glass-ceramic material. They can also be formed from ceramic tape. Other suitable materials include but are not limited to, ceramic reinforced glass, devitrified glass, amorphous glass in a flexible matrix, metal with electrically insulative coating, bulk resistance materials such as a titanium aluminum chromium oxide, high-temperature vacuum-compatible polyimides or insulators such as silicon nitride.

A field emitter cathode 22 can be formed on a surface of backplate 14 within envelope 18. Row and column electrodes control the emission of electrons from a cathodic emission element. The electrons are accelerated toward a phosphor-coated interior surface of faceplate 12. Integrated circuit chips 24 include driving circuitry for controlling the voltage of the row and column electrodes so that the flow of electrons to faceplate 12 is regulated. Electrically conductive traces are used to electrically connect circuitry on chips 24 to the row and column electrodes.

Spacers 20 can be synchronized with the vertical sweep of display 10. In this regard, spacers 20, which are perpendicular to the vertical sweep, can be corrected row by row, to remove any deflections of the pixels due to imperfections in walls or resistor uniformity.

If spacers 20 are formed of a substantially non-resistive material, then their sidewalls can be coated with a resistive coating or they can be surface doped. The resistive coating minimizes charge build-up on spacer 20 which can distort the flow of electrons. The coating can be formed on a spacer wall by methods well known in the art, including but not limited to, sputtering, evaporation, chemical vapor deposition, thermal or plasma-enhanced printing, roll-on, spraying or dipping.

Figure 2:
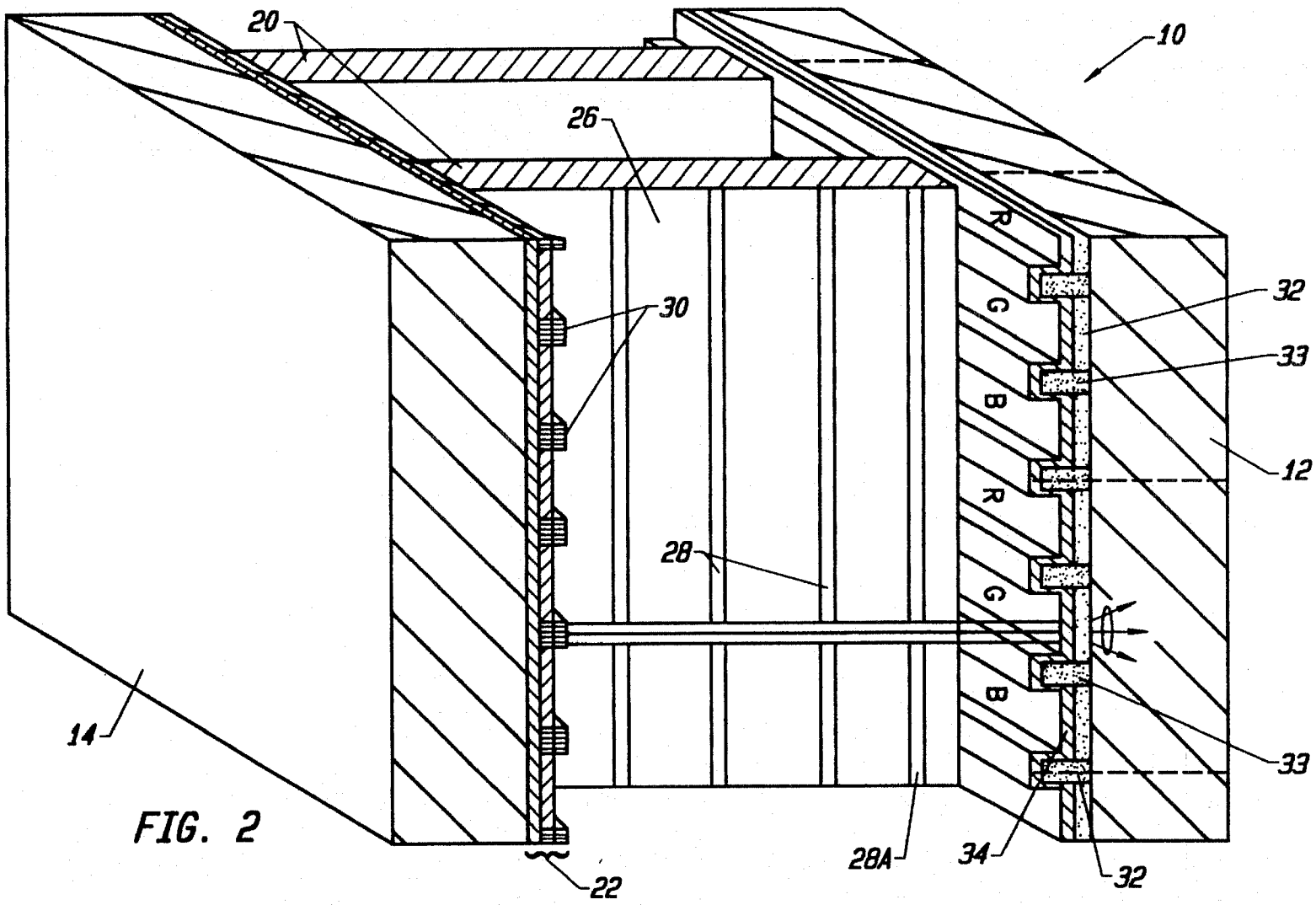
FIG. 2 is a detailed perspective sectional view of a portion of the flat panel display of FIG. 1.
Figure 3:
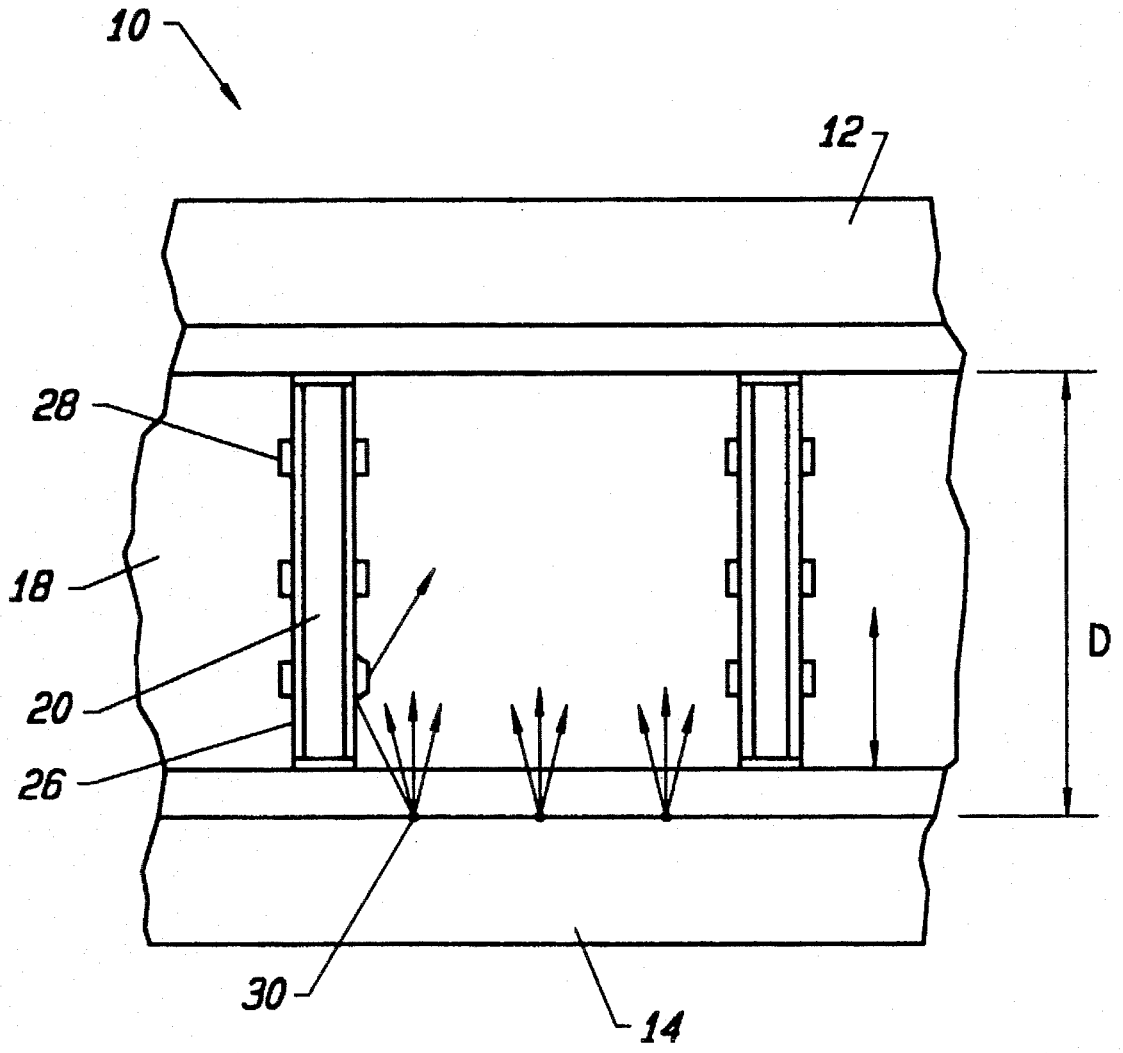
FIG. 3 is a cross-sectional view of a flat panel display according to an embodiment of the invention illustrating a coating formed on surfaces of the spacers.

Referring now to FIGS. 2 and 3, the surfaces of each spacer 20 are shown as being coated with a resistive coating 26. Spacer 20 can be made of bulk conductive materials. Generally, spacers 20 need not be coated if they are made of a high resistance material. It is desirable to form coating 26 with a sheet resistance uniformity of better then ±2%. This is achieved by controlling coating 26 within a specified tolerance. Resistive coating 26 prevents or minimizes charge build-up on spacers 20 that can distort the flow of electrons. Additionally, each end of spacer 20 has a substantially even, uniform ohmic contact near the boundaries of faceplate 12 and backplate 14.

Conductors 28, which can be considered as electrodes, are formed on the coated or uncoated surfaces of each spacer 20. This segments a voltage rise from emitters 30 toward target light emissive active area 19 made of a group of light emissive phosphors 32, separated by dark, non-reflective ridges 33 and a light reflective layer 34 which acts as the anode for display 10 (hereafter referred to as the "anode"). A plurality of focus ridges are formed between emitters 30.

Conductors 28 (hereafter "electrodes") extend generally from one end of a spacer 20 to the other end, preferably without any gaps in the electrode. However, it is possible that a conductor 28 be non-continuous, segmented without the segments being electrically connected, as it extends along spacer 20. Electrodes 28 provide for charge bleed-off from spacers 20 and can also provide an ability to tailor a potential drop along spacer 20. Electrodes 28 are formed of a material with a sheet resistance less than $10^5$ to $10^7$ Ω/□.

Generally, the voltage of each electrode 28 is set so that the voltage increases linearly, or nearly linearly, from the voltage level at emitters 30 to anode 34. Thus, electrons are accelerated toward faceplate 12 to strike phosphor 36 and cause light to emanate from display 10.

Referring specifically to FIG. 2, conductor 28(*a*), located nearest to faceplate 12, can be synchronized so that a selected voltage is applied to conductor 28(*a*). Application of this voltage corrects for pixel deflections resulting from spacer 20 misalignment, non-uniformity, and the like.

It is necessary that the voltage change near each spacer 20 also change linearly between emitters 30 and anode 34, so that the flow of electrons is not distorted, and the display image not degraded. Stray electrons emitted from emitters 30 can strike spacer 20 which can result in the accumulation of charge on the spacer. For a given electron density (current density j) striking spacer 20, an amount of charge equal to $j\cdot(1\delta)$ accumulates at the surface of spacer 20. $\delta$ and j are defined below. For $\delta\neq1$, the accumulation of charge causes a change in voltage at the surface of spacer 20 from the desired voltage, resulting in a non-zero flow of electrons from spacer 20. If the conductivity of spacer 20 is low, the change in voltage will cause the electron flow near spacer 20 to be distorted, resulting in degradation of the image display.

Specifically for the simple case of uniform charging current $j\cdot(1-\delta)$, the deviation of voltage near spacer 20 from the desired voltage (based on a linear voltage drop from emitters 30 to anode 34) is given by the equation:

$$\Delta V=\rho_s\cdot[x\cdot(x-d)/2]\cdot j\cdot(1-\delta) \quad (1)$$

where $\Delta V$=voltage deviation (in volts)

$\rho_s$=sheet resistance of the surface of the spacer wall (in ohms/□)

x=distance from nearest electrode, 0<x<d (in cm)

d=distance between electrodes (in cm)

j=current density striking the surface of spacer 30 (in $cm^2$)

$\delta$=secondary emission ratio (dimensionless)

Equation 1 assumes that the current density j strikes spacer 20 uniformly and that the sheet resistance $\rho_s$ of spacer 20 is uniform. More exactly, equation (1) accounts for the dependence of current density j on the position on spacer 20, and the dependence of the exact voltage at the position on spacer 20 on the secondary emission ratio $\delta$.

From equation (1), the maximum voltage deviation $\Delta V$ occurs at the midpoint between two electrodes 28 (i.e., the quantity $[x\cdot(x-d)/2]$ is maximized), and is proportional to the distance between the electrodes squared. For this reason, providing additional electrodes 28 minimizes the voltage deviation near spacer 20 and thus, the distortion of the flow of electrons toward faceplate 12. The addition of n electrodes of width w to a spacer 20 of height h reduces the power consumption of display 10, in the ideal case, according to the following ratio:

$$\frac{P_{new}}{P_{old}}=\frac{d-nw}{d\cdot(n+1)^2} \quad (2)$$

For example, the addition of four electrodes, each electrode with a width of 4 mils, to a spacer 20 with a height h of 100 mils reduces the $I^2R$ power loss for a given $\Delta V_{max}$ by a factor of about 30.

This more efficient charge bleed off allows a higher value of sheet resistance $\rho_s$ and significant savings in power consumption. However, each additional electrode 28 increases the manufacturing cost of display 10. Thus, the number of electrodes 28 is selected with a balancing of these two factors.

Electrodes 28 are substantially parallel across a particular spacer 20. They can be evenly spaced, but this is not required. Referring again to FIG. 1(*b*), electrodes 28 extend lengthwise along a sidewall of a spacer 20 that has a height of "h" and a length of L. Additionally, two electrodes 28 can be formed at opposite ends of spacer 20, with a slight gap between the two electrodes. In this embodiment, the total length of the two electrodes 28 will be less than $L_2$, such as 10% or less, or preferably 5% or less. The length of electrode 28 $L_2$ is at least equal to $L_1$, the corresponding length of the active area of the display, and both ends of electrode 28 can extend a length $L_2$ in an amount of about (1.0 to 1.5)·h. Thus, $L_2$, can be in the range of L to about L+(2.0 to 3.0)·h. The potential distribution on a spacer 20 can be tailored based on, (i) the position and potentials applied to electrodes 28, and (ii) thickness or conductivity of a spacer 20 from top to bottom along its height h. Electrodes 28 can be made of metals or other conductive materials including but not limited to semiconductors, and the like.

Figure 4:
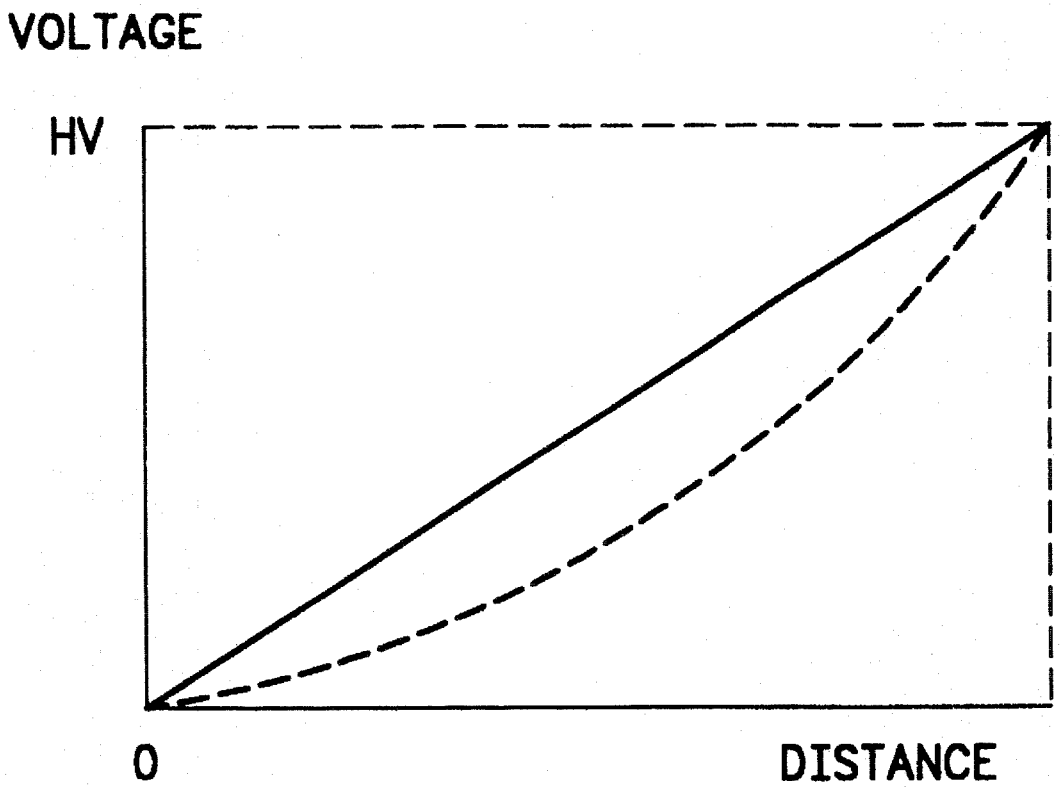
FIG. 4 is a graph of voltage versus distance from field emitters.

FIG. 4 is a graph of voltage versus distance from field emitters 22. Anode 34 is spaced apart from field emitters 22 by a distance D, and is held at a higher positive potential, designated as HV, than field emitters 22. The dashed line represents a tailored potential drop. Spacers 20 can be designed with electrodes 28 to have a selectable potential drop, as illustrated in FIG. 4.

Further from equation (1), for a given number of electrodes 28, the voltage deviation $\Delta V$ also decreases as the sheet resistance $\rho_s$ decreases, and as the secondary emission ratio $\delta$ approaches 1. Thus, it is desirable that the surfaces of spacers 20 have a low sheet resistance $\rho_s$ and a secondary emission ratio $\delta$ that approaches 1. Since the secondary emission ratio $\delta$ can only go as low as zero, but can increase to a very high number, the secondary emission ratio requirement is stated as a preference for a material having a low value of secondary emission ratio $\delta$.

Spacer 20 is a resistor, or an insulator coated with resistive coating 26. If spacer 20 is formed of a material with insufficient resistive characterists, then its sidewalls can be coated with a resistive coating, or they can be surface doped.

If spacer 20 is not made of a bulk conductor material, then the surfaces of spacers 20 can be treated so that the surface resistance is low relative to the bulk resistance of spacer 20. This enables charge to flow easily from a spacer 20 to backplate 14 or from faceplate 12, and the high potential difference across spacer 20 is maintained without running a high current through it.

In one embodiment of the invention spacers 20 are ceramic and coating 26 is a material having a secondary emission ratio $\delta$ less than 4 and a sheet resistance $\rho_s$ between $10^9$ and $10^{14}$ Ω/□. In an additional embodiment, the material used for coating 26 has the above sheet resistance □, and a secondary emission ratio $\delta$ is less than 2. Coating 26 in this embodiment is, for instance, chromium oxide, copper oxide, carbon, titanium oxide, vanadium oxide or a mixture of these materials, and has a thickness between 0.05 and 20 μm. The internal surfaces of faceplate 12 and backplate 14 are about 0.004 to 0.2 inches (about 0.1 to 5.0 mm) apart. Faceplate 12 is glass and has a thickness of about 0.040 inches (1.0 mm). Backplate 14 is glass, ceramic, or silicon having a thickness of 0.040 inches (1.0 mm). Each spacer 26 has a thickness of about 50 to 75 μm. The center-to-center spacing of spacers 26 is 8 to 25 mm.

Electrodes 28 are formed at intervalsion the surfaces of spacers 28 that are exposed to sealed envelope 18. Voltages at electrodes 28 are set by a voltage divider or a power supply. If a voltage divider is used, it can be either a coating or a resistive strip, inside or outside sealed envelope 18 of display 10. In order to achieve the desired voltages on each electrode 28, the voltage divider can be trimmed by removing material from the voltage divider at selected locations to increase the resistance at those locations as necessary. The trimming can be done, for instance, by using a laser to ablate material from the voltage divider. Alternatively, material can be removed from selected electrodes 28, e.g., the length of one or more electrodes 28 can be shortened, thus altering the properties of the voltage divider.

The foregoing description of preferred embodiments of the present invention has been provided for the purposes of illustration and description. It is not intended to be exhaustive or to limit the invention to the precise forms disclosed. Obviously, many modifications and variations will be apparent to practitioners skilled in this art. The embodiments were chosen and described in order to best explain the principles of the invention and its practical application, thereby enabling others skilled in the art to understand the invention for various embodiments and with various modifications as are suited to the particular use contemplated. It is intended that the scope of the invention be defined by the following claims and their equivalents.

What is claimed is:

1. A flat panel apparatus, comprising:

a faceplate;

a backplate positioned in an opposing relationship to the faceplate and connected in a sealed relationship to create a sealed envelope therebetween, the sealed envelope including a phosphor coated emissive area of length $L_1$;

a spacer in the envelope supporting the backplate and the faceplate against forces acting in a direction toward the envelope; and at least one electrode disposed on the spacer which extends a length $L_2$ along a side of the spacer that is at least equal to $L_1$, the voltage of the electrode being controlled to achieve a desired voltage distribution between the backplate and the faceplate.

2. The flat panel apparatus of claim 1, wherein the spacer has a height h, and each end of the electrode extends beyond the length $L_1$ of the active area in an amount of about (1.0 to 1.5)×h.

3. The flat panel apparatus of claim 1, wherein the spacer includes two or more electrodes that are positioned on the spacer in a substantially parallel relationship to each other.

4. The flat panel apparatus of claim 1, further comprising:

a voltage divider that establishes the voltage of each electrode.

5. The flat panel apparatus of claim 1, wherein the electrode includes at least a first electrode, and a second electrode, wherein the first electrode is located nearest to the faceplate than the second electrode and has a synchronized voltage applied to it to correct for pixel deflections.

6. The flat panel apparatus of claim 1, further comprising:

a power supply that establishes the voltage of the electrodes.

7. The flat panel apparatus of claim 4, wherein the voltage divider comprises a resistive coating formed on an exterior surface of the spacer.

8. The flat panel apparatus of claim 7, wherein resistive coating material is selectively removed from the voltage divider to establish the desired voltages on the electrodes,

9. The flat panel apparatus of claim 3, further comprising:

an electrically conductive trace extending from each electrode to a location outside the sealed envelope of the apparatus, wherein material is selectively removed from the trace to establish a desired voltage on each of the electrodes.

10. The flat panel apparatus of claim 1, further comprising:

a coating formed on an exterior surface of the spacer, the coating being made of a material that has a secondary emission ratio less than 4 and a sheet resistance between $10^9$ and $10^{14}$ Ω/□.

11. The flat panel apparatus of claim 10, wherein the electrodes are formed over the coating.

12. The flat panel apparatus of claim 10, wherein the electrodes are formed under the coating.

13. The flat panel apparatus of claim 3, wherein the electrodes are positioned along substantially equal segments on the spacer.

14. The flat panel apparatus of claim 3, wherein the electrodes are positioned along substantially non-equal segments on the spacer.

15. A flat panel apparatus, comprising:

a faceplate;

a backplate positioned in an opposing relationship to the faceplate;

an enclosure member positioned between the backplate and the faceplate to form a sealed envelope therebetween, the sealed envelope including a phosphor coated emissive area of length $L_1$;

a spacer in the envelope supporting the backplate and the faceplate against forces acting in a direction toward the envelope, the spacer having a selectable potential drop across an exterior surface of the spacer; and at least one electrode disposed on the spacer extending a length $L_2$ along a side of the spacer that is at least equal to $L_1$, the voltage of the electrode being controlled to achieve a desired voltage distribution between the backplate and the faceplate.

16. The flat panel apparatus of claim 15, wherein the spacer has a height h, and each end of the electrode extends beyond the length $L_1$ of the active area in an amount of about (1.0 to 1.5)×h.

17. The flat panel apparatus of claim 15, wherein the spacer includes two or more electrodes that are positioned on the spacer in a substantially parallel relationship to each other.

18. The flat panel apparatus of claim 15, further comprising:

a voltage divider that establishes the voltage of each electrode.

19. The flat panel apparatus of claim 18, wherein the electrode includes at least a first electrode and a second electrode, wherein the first electrode is located nearest to the faceplate than the second electrode and has a synchronized voltage applied to correct for pixel deflections.

20. The flat panel apparatus of claim 15, wherein the voltage divider comprises a resistive coating formed on an exterior surface of the spacer.

21. The flat panel apparatus of claim 20, wherein resistive coating material is selectively removed from the voltage divider to establish the desired voltages on the electrodes.

22. The flat panel apparatus of claim 17, further comprising:

an electrically conductive trace extending from each electrode to a location outside the sealed envelope of the apparatus, wherein material is selectively removed from the trace to establish a desired voltage on each of the electrodes.

23. The flat panel apparatus of claim 15, further comprising:

a coating formed on an exterior surface of the spacer, the coating being made of a material that has a secondary emission ratio less than 4 and a sheet resistance between $10^9$ and $10^{14}$ Ω/□.

24. The flat panel apparatus of claim 23, wherein the electrodes are formed over the coating.

25. The flat panel apparatus of claim 23, wherein the electrodes are formed under the coating.

26. A flat panel apparatus, comprising:

a faceplate;

a backplate positioned in an opposing relationship to the faceplate and connected in a sealed relationship to create a sealed envelope therebetween, the sealed envelope including a phosphor coated emissive area of length $L_1$;

a spacer in the envelope supporting the backplate and the faceplate against forces acting in a direction toward the envelope; and at least two electrodes disposed on the spacer from opposite ends of the spacer which extend a length $L_2$ along a side of the spacer that is at least equal to 90% of $L_1$, the voltage of the electrodes being controlled to achieve a desired voltage distribution between the backplate and the faceplate.

27. A flat panel apparatus, comprising:

a faceplate;

a backplate positioned in an opposing relationship to the faceplate;

an enclosure member positioned between the backplate and the faceplate to form a sealed envelope therebetween;

a spacer in the envelope supporting the backplate and the faceplate against forces acting in a direction toward the envelope; and at least one electrode disposed on the spacer formed of a material having a sheet resistance of no greater than about $10^7$ Ω/□.

28. The flat panel apparatus of claim 27, wherein the spacer is formed of a material with a sheet resistance of no greater than about $10^5$ Ω/□.

29. The flat panel apparatus of claim 27, wherein the spacer has a selectable potential drop across an exterior surface of the spacer.

30. The flat panel apparatus of claim 27, wherein a voltage of the electrode is controlled to achieve a desired voltage distribution between the backplate and the faceplate.

* * * * *